United States Patent [19]

Levine

[11] Patent Number: 4,557,478

[45] Date of Patent: Dec. 10, 1985

[54] HEAVY BAG STAND

[76] Inventor: Norman D. Levine, 2205 NW. 30 Pl., Pompano Beach, Fla. 33060

[21] Appl. No.: 612,474

[22] Filed: May 21, 1984

Related U.S. Application Data

[63] Continuation-in-part of Ser. No. 346,892, Feb. 8, 1982, Pat. No. 4,482,150.

[51] Int. Cl.[4] ..... A63B 69/00
[52] U.S. Cl. ..... 272/78
[58] Field of Search ..... 272/78, 76, 77; 273/55 R

[56] References Cited

U.S. PATENT DOCUMENTS

| | | | |
|---|---|---|---|
| 843,389 | 2/1907 | Brown | 272/78 |
| 2,625,356 | 1/1953 | Kennedy et al. | 272/78 |
| 3,411,497 | 11/1968 | Rickey et al. | 272/78 |
| 3,510,131 | 5/1970 | Gardner | 272/78 |

*Primary Examiner*—Richard C. Pinkham
*Assistant Examiner*—T. Brown
*Attorney, Agent, or Firm*—Eugene F. Malin

[57] ABSTRACT

A heavy body bag support stand mounted partially under a platform on which the user stands to anchor the body bag to the floor by the use of the boxers weight, when the heavy body bag is used. The stand supports the platform along one edge to provide a resilient platform. The support stand is formed of conduit with conduit braces attached by connecting means.

7 Claims, 10 Drawing Figures

HEAVY BAG STAND

This application is a continuation-in-part of application Ser. No. 06/346,892, filed Feb. 8, 1982 (now Pat. No. 4,482,150).

BACKGROUND OF THE INVENTION

In the past, light punching bag supports have been constructed such as disclosed in U.S. Pat. No. 3,510,131. Such lightweight bag stands have been large structures with integral platforms fixed to the stand. The platforms are generally of rigid construction and are fixed to the stand. Due to the heavier weight of a body bag device and the increased stress required for their support due to the heavier type punching for which they are commonly used, body bags are usually suspended from a permanent building structure such as a wall or ceiling member.

SUMMARY OF THE INVENTION

This invention relates to a relatively lightweight support stand for a combination heavy body bag and light punching bag for adult use which can also be used for jumping rope and other exercises. In this invention the position of the boxer's body on a platform and the flexibility and resilience of the platform in relationship to the heavy body bag and support stand provides an improved portable punching bag stand. The stresses placed on the support stand by a heavy bag in movement due to a boxer's full body blows with his fists are overcome by the present invention. This invention utilizes permanently attached flexible sheets of plywood upon which the boxer stands thereby providing a platform for a boxer. The weight and movement of the boxer aids in maintaining the heavy body bag mounted on a stand in an upright position.

It is an object of this invention to provide a knock-down support stand with a resilient platform which is easily assembled with common tools.

Another object of this invention is to provide a resilient platform with adjustable flexibility.

A further object of this invention is to provide a body bag support stand that may be alternatively used as an adjustable jump rope jumping platform or as a platform for other exercises.

It is yet another object of this invention to provide a combination heavy body bag and light punching bag stand with at least one resilient platform that aids in supporting the heavy body bag.

It is still yet another object of the invention to provide a combination heavy body bag and light punching bag stand with tension spring means capable of decreasing vibration of the heavy bag and for permitting the heavy body bag to instantly return to its normal vertical position after each impact of force by the fist of an athlete.

In accordance with these and other objects which will be apparent hereinafter, the instant invention will now be described with particular reference to the accompanying drawings.

DESCRIPTION OF PREFERRED EMBODIMENT

Figure 1:
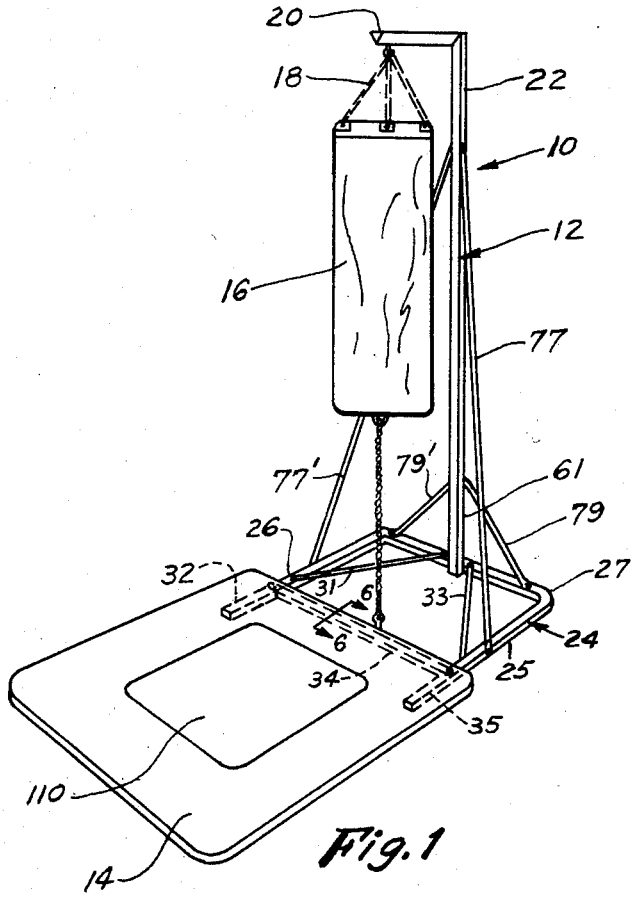
FIG. 1 illustrates an isometric view of one embodiment of the invention.
Figure 6:
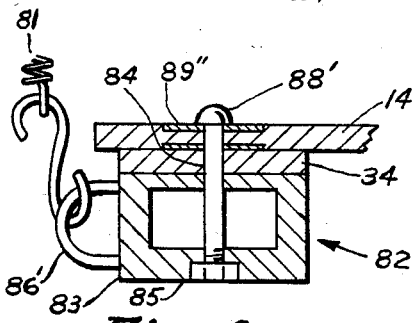
FIG. 6 is an enlarged fragmentary section view of a coupling member for a spring element.

Referring to FIG. 1 showing a heavy bag support stand 10 with a frame 12, a removable resilient platform 14 and a heavy bag 16. The bag 16 is connected by linked chains 18 to a horizontal cantilever carrying member 20 connected by a weld or other conventional connecting means to a vertical member 22. The vertical member 22 may be welded or removably secured to a U-shaped single unit floor frame 24 as shown in FIG. 6 of my parent application. End 26'' in FIG. 2 on vertical member 12 may be in contact with the floor and may be bolted to the floor frame 24.

The floor frame 24 is placed on floor as shown in FIG. 1. The right member 25 and a left member 26 individual members may be removably secured to member 27 by separate bolts (not shown) and to the vertical member 12. The frame 24 may include cross members 31, 33 and 34, removably secured together by conventional nuts and bolts. The ends of members 25 and 26 are shown as members 32 and 35 and support the front edge 36 of platform 14 spaced from the floor as shown in FIG. 1. Ends 32 and 35 show the distance the platform may be held spaced from the floor to provide resilience and flexibility of the board 14. The platform 14 is resilient flexible platform that will bounce and flex with a user The platform 14 may be a 4 foot by 4 foot fur plywood board with a non skid surface portion 110. Platform 14 is detachably secured to cross member 34 as described herein.

Figure 9:
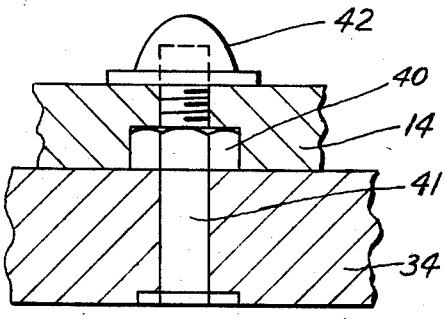
FIG. 9 is an enlarged view showing means connecting the platform to a rail or bar element of FIG. 2.

As more clearly illustrated in FIG. 9, the ends 32 and 35 and cross member 34 include holes 38, 39 (not shown). Threaded nuts 40 are permanently secured to ends 32, 34 and to cross member 34, the diameter of the holes and nuts being substantially identical and are adapted to receive threaded bolts 41 (FIG. 9) for removably securing the platform to cross member 34. Nuts 40 may be countesunk in cross member 34 or secured within the undersurface of platform 14 which has a plurality of through bores through which the bolts are threaded as illustrated. The end of the bols mag be provided with resilient protective cups 42.

Figure 10:
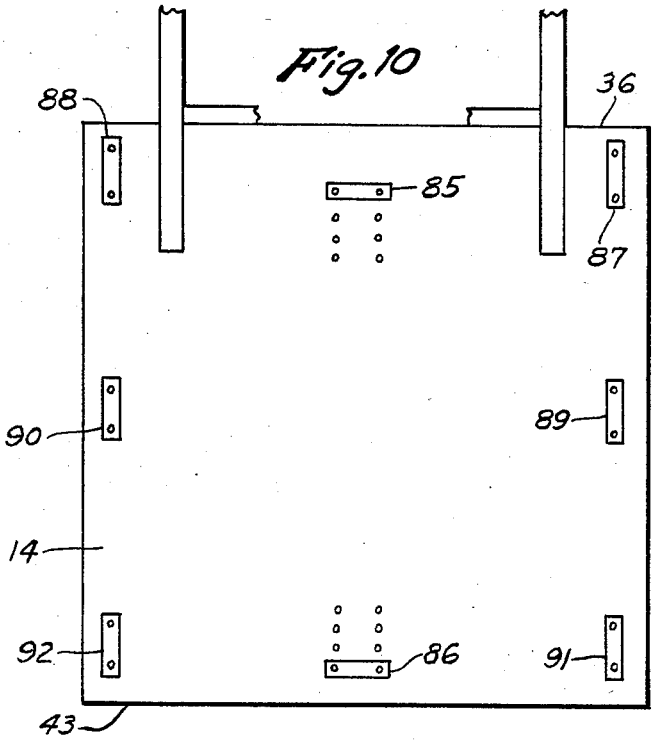
FIG. 10 is an underside view of the platform, respectively.

It should be noted that platform 14 as shown in FIG. 10 has rear edge 43 that may be elevated by a plurality of blocks or tabs 85, 86, 87, 88, 89, 90, 91 and 92. The blocks cooperate with connecting means 40, 41 and may be 8 inches from edge 36 in FIG. 10 for holding platform where the non skid pad 110 is located relatively free to flex under the weight and movement of the athlete or user. The tabs are screwed or bolted into the platform. Tabs 86 and 85 are adjustable by movement and connection with nuts in openings in the plurality of holes shown in FIG. 10.

Figure 2:
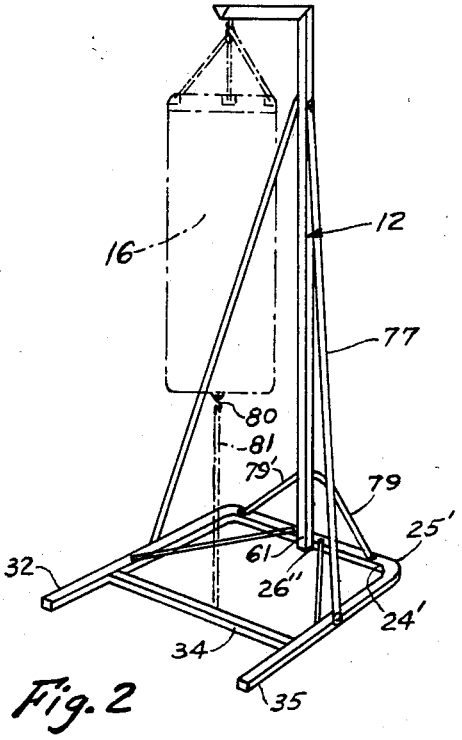
FIG. 2 illustrates a view similar to FIG. 1 with the omission of the platform.
Figure 3:
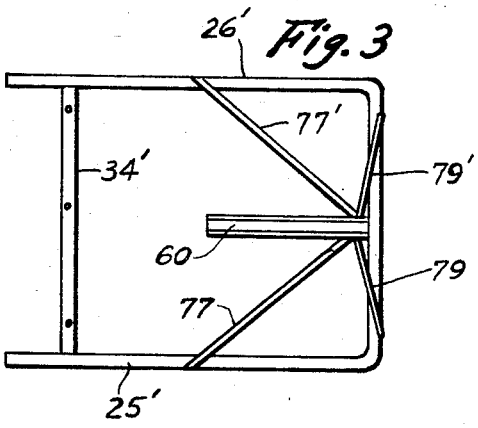
FIG. 3 is a partial plan view of FIG. 2.
Figure 4:
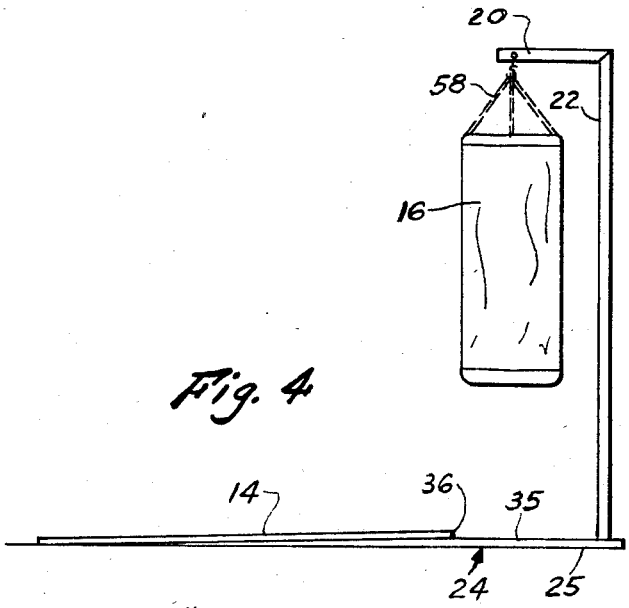
FIG. 4 is a partial side view of FIG. 2.
Figure 5:
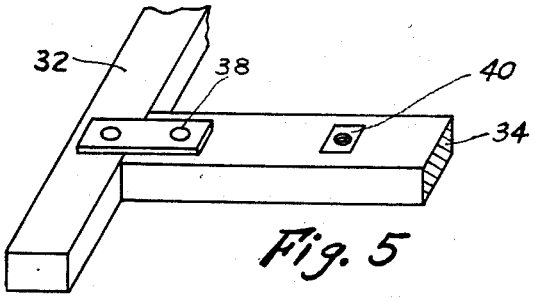
FIG. 5 is enlarged fragmentary detail view of a section of FIG. 2 with certain parts omitted for clarity.

The floor frame 24 is placed on a floor. The floor frame 24 may include additional supports 77, 79, 77' and 79′ as shown in FIGS. 1, 2 and 3 which may be removably secured by screws or bolts onto the horizontal and vertical members. The resilient platform will bounce since at least one edge and preferrably all edges are off or spaced from the floor. The center portion of the platform is held above the floor and is permitted to move upwardly and downwardly with the movement of the user.

Figure 7:
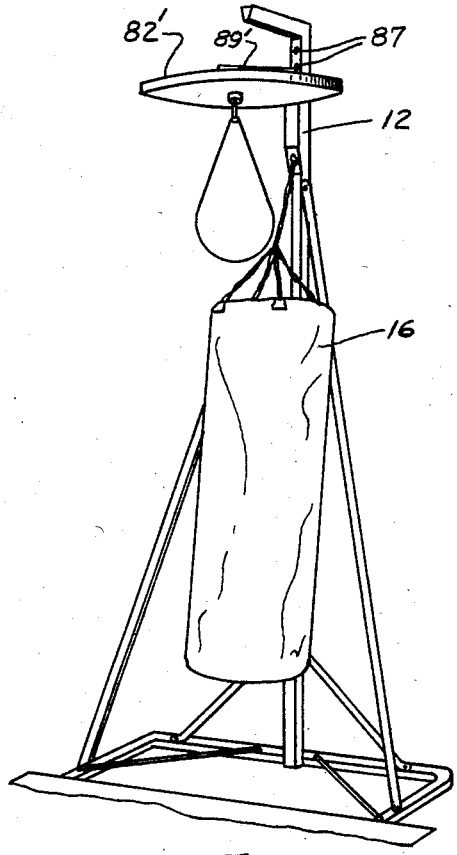
FIG. 7 is an isometric view of a portion of a combination heavy body bag and light punching bag.
Figure 8:
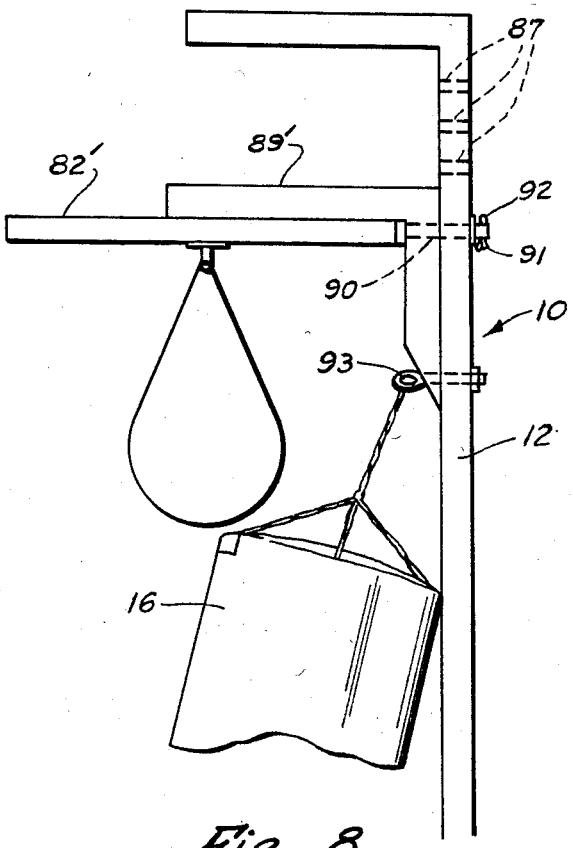
FIG. 8 is a fragmentary side view of FIG. 7.

The combination heavy body punching bag and light punching bag combination stand as shown in FIGS. 7 and 8 may include one or more cross bars 34 connected to floor frame 24. Heavy body punching bag includes hook means 80 (FIG. 2) or similar means mounted to the bottom of the heavy bag, preferably at the center thereof, for fastening one end of a tension spring 81, the other end of the tension spring being secured to the cross bar 34 preferably in the middle thereof as shown in FIGS. 1 and 2.

FIG. 6 illustrates means 82 for connecting the opposite end of tension spring 81 to the cross bar 34. Means 82 includes a hollow metal or structural element or block 83 having a bore 84 for receiving a bolt 88 which threadedly engages a nut 85 countersunk as shown in element 83 for securing element 83 to the underside of platform 14 and cross bar 34. Platform 14 may include a countersunk washer 89″ or washer 89″ may be mounted on the surface of the platform. A U-shaped element 86′ is permanently secured, as by a weld, to the side of the element to provide means for receiving an S-hook for receiving the opposite end of tension spring 81.

The spring means in conjunction with the weight of the heavy bag increases the stability at the heavy bag when contacted by the impact force of the fist of an athlete providing greater resistance to movement or less vibration of the heavy bag. The spring means also prevents excessive lateral movement of the bag thereby obviating possible accidental bag contact with the body of the athlete with consequent injury.

FIGS. 7 and 8 illustrate utilization of the frame 12 of stand 10 for mounting means for swivelling mounting a light punching bag. In this embodiment frame 12 includes a plurality of spaced apertures 87 for adjustably positioning a circular backboard 82′ of about two inches thick. The backboard has an inverted L-shaped element 89′ secured to the top surface of board 82′, the vertical portion of element 89′ including apertures 90 communicating with at least two apertures 87 which receive bolts 91 maintained securely by nuts 92 for maintaining L-shaped element or frame 12. The underside of backboard 82 includes hook means or other means for swivelly mounting a light punching bag. When the light punching bag is in use, the heavy punching bag is removably secured to hook means 93 secured to the end of the vertical portion of the L-shaped element 89′. The adjustable means permits persons of different height to utilize the light punching bag. Thus, support 10 can be utilized for mounting either a light or heavy punching bag. When utilizing the stand solely for supporting the heavy punching bag, the backboard and connecting elements are removed from stand 12.

FIGS. 7 and 8 illustrates a combination heavy body punching bag and light punching bag combination stand.

The device may be sold knockdown as a nine piece item, 22, 25, 26, 31, 33, 77, 77′, 79, and 79′. The vertical member 12 may be in two pieces with an upper piece and a lower straight piece connected in the upper piece.

It should be noted that the nonskid material 110 in FIG. 1 plaed on the board aids in preventing slips especially of water is dropped thereon. Bathtub-type skid material, such as a vinyl pad, with an upper surface of grit, may be utilized.

Alternatively, members 31 and 33 may be welded in place. Also members 79 and 79′ may be a bent unitary one piece item generally V-shaped instead of in two pieces. Members 77 and 77′ may also be a single V-shaped instead of in two pieces. Members 77 and 77′ may also be made of a V-shaped one-piece member.

The heavy bag may weigh from forty (40) pounds to one hundred sixty (160) pounds or more.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A portable knockdown boxing exercising equipment comprising:

(a) a stand for selectively mounting in operative position a punching bag, said stand including:

(1) a substantially U-shaped member adapted to be positioned on a floor including a horizontal element and at least two substantially parallel elements disposed perpendicular to said horizontal element and secured thereto, (2) an elongated element disposed vertical to the floor and secured at one of its ends perpendicularly to said horizontal element substantially in the center thereof, (3) strut means connected to said horizontal and vertical elements for structurally bracing said elements, and (4) a cantilever element having one end connected to the other end of said vertical element and means at its other end for attaching a heavy punching bag, (b) a cross-bar spaced from and substantially parallel to said horizontal element and connected to said substantially parallel elements, said cross bar including a plurality of spaced apertures and having fastening means disposed in conjunction with each of said apertures, (c) a resilient flexible platform having a thickness capable of flexure under the weight and jumping movement of a user of the equipment, said platform having top and bottom surfaces, a central area, and first and second edges, said platform including spaced apertures at the first edge thereof adapted to overlie said apertures in said cross-bar; and (d) said fastening means removably securing said platform to said cross-bar with resultant spacing of said first edge above a floor while spacing said second edge above a floor in a cantilever fashion.

2. An exercising device as recited in claim 1 further including:

(e) a heavy punching bag attached to said attaching means at the other end of said cantilever element, the lower end of said punching bag being spaced above said platform for permitting free and unobstructed swinging movement of said bag when contacted by a user.

3. An exercising device as recited in claim 2 wherein said means attaching said heavy bag includes a chain.

4. An exercising device as recited in claim 2, including an elongated resilient means, releasable securing means and attachment means intermediate the ends of said cross-bar, said resilient means having one of its ends connected to the bottom of said punching bag and its other end releasably connected to said attachment means by said releasable securing means, for effectively reducing vibration of said heavy bag with consequent return of said bag to a normal at rest position.

5. An exercising device as recited in claim 4 wherein said resilient means is a tension spring.

6. An exercising device as recited in claim 4 wherein said attaching means intermediate the ends of said cross-bar comprises:

(a) a hollow block having an aperture therethrough, (b) means engaging said apertures in said cross-bar and said block for securing said block to said platform, and (c) said block including means for receiving said releasable securing means.

7. An exercising device as recited in claim 1 wherein said resilient platform means is plywood and includes at the bottom thereof a plurality of spaced blocks disposed about the perimeter for permitting varying of the degree of resilience of said platform at the center thereof.

* * * * *